US007189139B2

(12) United States Patent
Ono

(10) Patent No.: US 7,189,139 B2
(45) Date of Patent: Mar. 13, 2007

(54) POLISHING APPARATUS

(75) Inventor: Katsutoshi Ono, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 11/098,430

(22) Filed: Apr. 5, 2005

(65) Prior Publication Data

US 2005/0221720 A1 Oct. 6, 2005

(30) Foreign Application Priority Data

Apr. 5, 2004 (JP) ..... 2004-111510

(51) Int. Cl.
*B24B 49/00* (2006.01)
*B24B 51/00* (2006.01)
*B24B 1/00* (2006.01)

(52) U.S. Cl. ..... 451/5; 451/8; 451/11; 451/41; 451/56; 451/285; 451/286; 451/287; 451/443; 451/444

(58) Field of Classification Search ..... 451/5, 451/8, 11, 41, 56, 285, 286, 287, 443, 444
See application file for complete search history.

(56) References Cited

U.S. PATENT DOCUMENTS 5,036,015 A 7/1991 Sandhu et al.
5,308,438 A * 5/1994 Cote et al. ..... 216/86
5,741,171 A * 4/1998 Sarfaty et al. ..... 451/6
6,293,845 B1 * 9/2001 Clark-Phelps ..... 451/5
6,300,247 B2 * 10/2001 Prabhu ..... 438/691
6,623,334 B1 9/2003 Birang et al.
6,739,947 B1 5/2004 Molnar
6,743,075 B2 6/2004 Lin et al.
6,780,086 B2 8/2004 Fortin et al.
6,786,799 B2 9/2004 Moore
2004/0242122 A1 * 12/2004 Kramer et al. ..... 451/5

* cited by examiner

*Primary Examiner*—Lee D. Wilson
*Assistant Examiner*—Shantese L. McDonald
(74) *Attorney, Agent, or Firm*—Wenderoth, Lind & Ponack, L.L.P.

(57) ABSTRACT

A polishing apparatus can detect completion of initialization of a polishing pad quantitatively. The polishing apparatus has a polishing table having a polishing pad attached thereto and a substrate holder configured to bring a surface of a substrate into contact with the polishing pad and press the substrate against the polishing pad. The polishing apparatus also has a drive mechanism operable to drive at least one of the polishing table and the substrate holder so as to provide a relative movement between the polishing pad and the substrate. The polishing apparatus includes a current sensor operable to detect a drive current supplied to the driving mechanism. The polishing apparatus also includes a polishing pad condition detector operable to detect a condition of the polishing pad based on the drive current detected by the current sensor when the dummy substrate is polished by a relative movement between the polishing pad and a dummy substrate held by the substrate holder.

7 Claims, 4 Drawing Sheets

POLISHING APPARATUS

BACKGROUND OF THE INVENTION

1. Field of the Invention

The present invention relates to a polishing apparatus, and more particularly to a polishing apparatus for polishing a workpiece such as silicon on insulator (SOI), a bare silicon wafer, or an oxide film wafer. The present invention also relates to a method of detecting completion of an initialization process of a polishing pad attached to a polishing table.

2. Description of the Related Art

There has been developed a polishing apparatus for polishing a substrate such as an SOI wafer, a bare silicon wafer, or an oxide film wafer. Such a polishing apparatus includes a polishing table having a polishing pad, such as flexible polyurethane foam, attached to an upper surface of the polishing table, and a top ring for holding and rotating a substrate. The substrate, which is rotated by the top ring, is brought into contact with the polishing pad provided on the rotating polishing table and pressed against the polishing pad. Thus, the substrate is polished by relative movement between the substrate and the polishing pad. When a new polishing pad is attached to the upper surface of the polishing table, an initialization process should be performed for the new polishing pad prior to a polishing process. Specifically, a polishing pad such as a flexible polyurethane foam pad has a protective layer formed as an uppermost layer. Accordingly, an initialization process is required to remove the protective layer before a polishing process.

In a conventional polishing apparatus, a predetermined number of dummy wafers (three to eighty dummy wafers) are polished to initialize a polishing pad. Then, a monitor wafer is polished to measure a polishing rate or precision of a polished surface of the monitor wafer. Thus, completion of the initialization process of the polishing pad is detected based on the measurement results. However, timing of the detection largely depends on the operator's experience. Accordingly, it is impossible to quantitatively determine when the initialization process of the polishing pad is completed. Further, since polishing pads have different qualities, the period of time required for an initialization process varies according to the polishing pads. In consideration of these variations, the initialization process is continued for a period longer than the period required for actual initialization.

Although there has been known a method of detecting an endpoint of a polishing process of a semiconductor wafer, such a method is not employed to detect completion of an initialization process of a polishing pad.

SUMMARY OF THE INVENTION

The present invention has been made in view of the above drawbacks. It is, therefore, a first object of the present invention to provide a polishing apparatus which can quantitatively detect completion of initialization of a polishing pad.

A second object is to provide a method of quantitatively detecting completion of an initialization process of a polishing pad attached to a polishing table.

According to a first aspect of the present invention, there is provided a polishing apparatus which can quantitatively detect completion of initialization of a polishing pad. The polishing apparatus includes a polishing table having a polishing pad attached thereto and a workpiece holder configured to bring a surface of a workpiece into contact with the polishing pad and press the workpiece against the polishing pad. The polishing apparatus has a drive mechanism operable to drive at least one of the polishing table and the workpiece holder so as to provide a relative movement between the polishing pad and the workpiece. The polishing apparatus includes a current sensor operable to detect a drive current supplied to the driving mechanism. The polishing apparatus also includes a polishing pad condition detector operable to detect a condition of the polishing pad based on the drive current detected by the current sensor when a relative movement is provided between the polishing pad and a dummy workpiece held by the workpiece holder so as to polish the dummy workpiece. The driving mechanism may include a first drive motor operable to rotate the workpiece holder and/or a second drive motor operable to rotate the polishing pad.

A polishing pad such as a flexible polyurethane foam pad has a protective layer formed as an uppermost layer. When a new polishing pad is attached to the polishing table, a dummy workpiece held by the workpiece holder is brought into contact with the polishing pad and pressed against the polishing pad. Different frictional forces are produced between the workpiece and the polishing pad before and after the protective layer has been polished and removed. Accordingly, the drive current supplied to the drive mechanism are changed. According to the present invention, the current sensor is provided to detect the drive current supplied to the drive mechanism. The drive current detected by the current sensor is compared with a current value (threshold) supplied to the drive mechanism when the protective layer of the polishing pad has been removed, i.e., when the initialization process has been completed. When the detected drive current reaches the threshold, it is determined that the initialization process of the polishing pad has been completed.

Thus, according to the present invention, the polishing pad condition detector can detect a condition of the polishing pad, i.e., when a protective layer formed as an uppermost layer of the polishing pad is removed or when the polishing pad becomes ready for polishing a workpiece.

The polishing pad condition detector may detect completion of an initialization process of the polishing pad based on the drive current detected by the current sensor when the polishing pad is attached to the polishing table. Thus, the completion of an initialization process of the polishing pad can quantitatively be detected.

The polishing pad condition detector may compare the drive current with a predetermined threshold and detect the completion of the initialization process of the polishing pad when the drive current reaches the predetermined threshold. By setting the predetermined threshold to be a drive current supplied to the drive mechanism when the protective layer as the uppermost layer of the polishing pad has been removed, the completion of the initialization process of the polishing pad can be detected with high accuracy. Accordingly, the polishing pad is prevented from being worn wastefully. Further, a substrate is prevented from being polished with a polishing pad that is not ready for polishing the substrate.

The polishing pad condition detector may send a signal representing the completion of the initialization process of the polishing pad to a control device configured to control the polishing apparatus when the polishing pad condition detector detects the completion of the initialization process of the polishing pad. Thus, the control device can control the polishing apparatus in response to the completion of the initialization process of the polishing pad. Accordingly, operational efficiency of the polishing apparatus can be improved.

According to a second aspect of the present invention, there is provided a method of quantitatively detecting completion of an initialization process of a polishing pad attached to a polishing table. According to this method, a surface of a dummy workpiece is brought into contact with the polishing pad and pressed against the polishing pad by a workpiece holder. At least one of the polishing table and the workpiece holder is driven so as to provide a relative movement between the polishing pad and the dummy workpiece. A drive current supplied for driving at least one of the polishing table and the workpiece is detected, and completion of an initialization process of the polishing pad is detected based on the detected drive current. The dummy workpiece may be rotated by a first drive motor. The polishing pad may be rotated by a second drive motor. With this method, it is possible to quantitatively detect the completion of the initialization process of the polishing pad.

The detected drive current may be compared with a predetermined threshold, and the completion of the initialization process of the polishing pad may be detected when the detected drive current reaches the predetermined threshold. By setting the predetermined threshold to be a drive current supplied when the protective layer as the uppermost layer of the polishing pad has been removed, the completion of the initialization process of the polishing pad can be detected with high accuracy. Accordingly, the polishing pad is prevented from being worn wastefully. Further, a substrate is prevented from being polished in a state such that the polishing pad is not ready for polishing the substrate.

According to a third aspect of the present invention, there is provided a method of quantitatively detecting completion of an initialization process of a polishing pad attached to a polishing table. According to this method, a polishing pad having a protective layer formed on a surface thereof is attached to a polishing table. A surface of a dummy workpiece is brought into contact with the polishing pad and pressed against the polishing pad by a workpiece holder to remove the protective layer of the polishing pad. At least one of the polishing table and the workpiece holder is driven so as to provide a relative movement between the polishing pad and the dummy workpiece. A drive current supplied for driving at least one of the polishing table and the workpiece holder is detected, and removal of the protective surface of the polishing pad is detected based on the detected drive current.

According to a fourth aspect of the present invention, there is provided a method of quantitatively detecting completion of an initialization process of a polishing pad attached to a polishing table. According to this method, a polishing pad having a protective layer formed on a surface thereof is attached to a polishing table. A surface of a dummy workpiece is brought into contact with the polishing pad and pressed against the polishing pad by a workpiece holder to remove the protective layer of the polishing pad. At least one of the polishing table and the workpiece holder is driven so as to provide a relative movement between the polishing pad and the dummy workpiece. A drive current supplied for driving at least one of the polishing table and the workpiece holder is detected, and removal of the protective surface of the polishing pad is detected based on the detected drive current. Then, a surface of a workpiece is brought into contact with the polishing pad and pressed against the polishing pad by the workpiece holder to polish the workpiece.

According to a fifth aspect of the present invention, there is provided a method of quantitatively detecting completion of an initialization process of a polishing pad attached to a polishing table. According to this method, a polishing pad having a protective layer formed on a surface thereof is attached to a polishing table. A dresser is brought into contact with the polishing pad and pressed against the polishing pad to remove the protective layer of the polishing pad. At least one of the polishing table and the dresser is driven so as to provide a relative movement between the polishing pad and the dresser. A drive current supplied for driving at least one of the polishing table and the dresser is detected, and removal of the protective surface of the polishing pad is detected based on the detected drive current.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Figure 1:
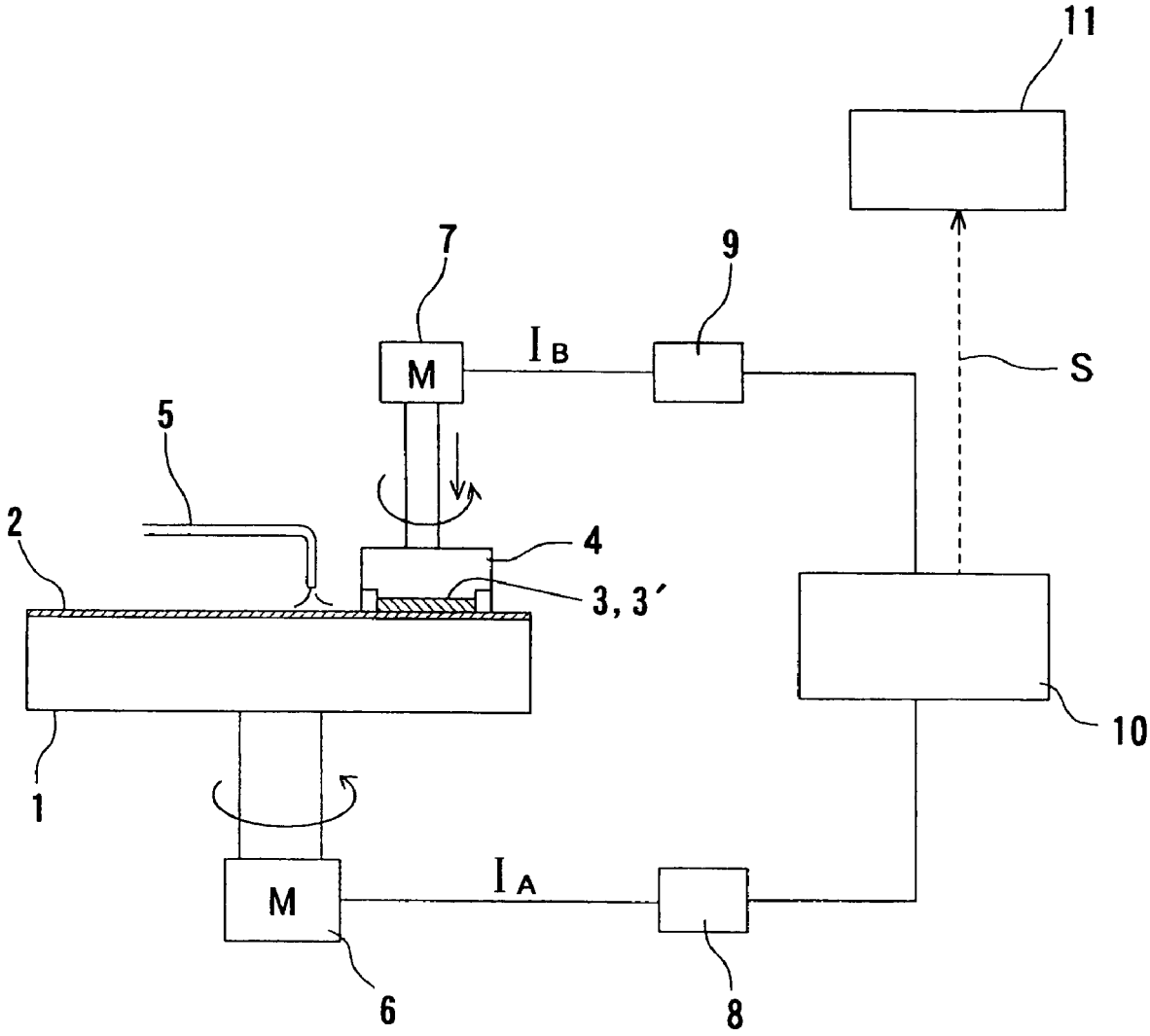
FIG. 1 is a schematic view showing a polishing apparatus according to an embodiment of the present invention.

A polishing apparatus according to an embodiment of the present invention will be described below with reference to FIGS. 1 through 5. Like or corresponding parts are denoted by like or corresponding reference numerals throughout drawings, and will not be described below repetitively.

FIG. 1 is a schematic view showing a polishing apparatus according to an embodiment of the present invention. As shown in FIG. 1, the polishing apparatus has a polishing table 1 having a polishing pad 2 attached to an upper surface thereof, a polishing table motor 6 for rotating the polishing table 1, a top ring 4 for holding a substrate 3 such as an SOI wafer, a bare silicon wafer, or an oxide film wafer, a top ring motor 7 for rotating the top ring 4, and a polishing liquid supply nozzle 5 for supplying a polishing liquid (slurry) onto the polishing pad 2. Thus, the top ring 4 serves as a holder for bringing a surface of a workpiece into contact with the polishing pad 2 and pressing the workpiece against the polishing pad 2. The polishing table motor 6 and the top ring motor 7 serve as a driving mechanism to drive the polishing table 1 and the top ring 4 so as to provide relative movement between the polishing table 1 and the top ring 4.

The polishing table 1 and the top ring 4 are rotated by the polishing table motor 6 and the top ring motor 7, respectively, while a polishing liquid (slurry) is supplied from the polishing liquid supply nozzle 5 onto the polishing pad 2. The substrate 3 held by the top ring 4 is brought into contact with the polishing pad 2 on the polishing table 1 and pressed against the polishing pad 2. Thus, the substrate 3 is polished by relative movement between the substrate 3 and the polishing pad 2.

Figure 2:
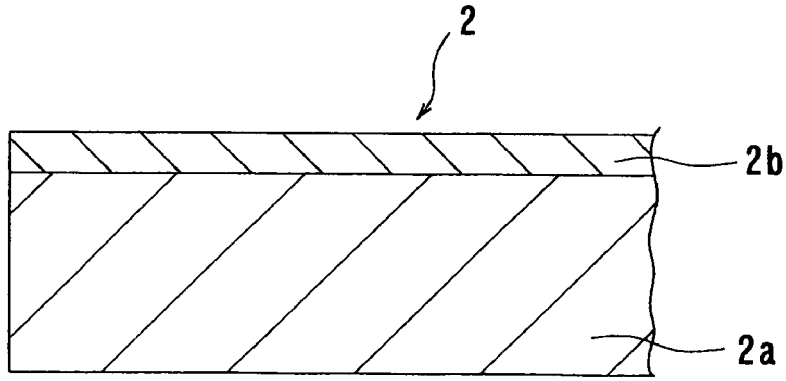
FIG. 2 is a vertical cross-sectional view showing a polishing pad in the polishing apparatus shown in FIG. 1.

When a new polishing pad 2 is attached to the upper surface of the polishing table 1, an initialization process should be performed on the new polishing pad 2 prior to a polishing process. Specifically, as shown in FIG. 2, a polishing pad 2 such as a flexible polyurethane foam pad has a base layer 2*a* and a protective layer 2*b* formed on an upper surface of the base layer 2*a*. Accordingly, an initialization process is required to remove the protective layer 2*b* from the base layer 2*a* before a polishing process. When a new polishing pad 2 is attached to the upper surface of the polishing table 1, a dummy substrate 3' held by the top ring 4 is brought into contact with the polishing pad 2 and pressed against the polishing pad 2 to thereby remove the protective layer 2*b* from the base layer 2*a*. Specifically, the protective layer 2*b* is polished and removed by relative movement between the dummy substrate 3', which is rotated together with the top ring 4, and the polishing pad 2, which is rotated together with the polishing table 1.

When the dummy substrate 3' is brought into contact with the new polishing pad 2 and pressed against the new polishing pad 2, a frictional force $F_1$ is initially produced between the protective layer 2*b* and the dummy substrate 3'. When the protective layer 2*b* has been polished and removed from the base layer 2*a*, a frictional force $F_2$ is produced between the base layer 2*a* and the dummy substrate 3'. Thus, when a contact surface of the dummy substrate 3' is changed from the protective layer 2*b* to the base layer 2*a*, a drive current (motor drive current) supplied to the polishing table motor 6 to rotate the polishing table 1 is changed because of the difference between the frictional force $F_1$ and the frictional force $F_2$ ($F_1<F_2$). Similarly, a drive current (motor drive current) supplied to the top ring motor 7 to rotate the top ring 4 is also changed because of the difference between the frictional force $F_1$ and the frictional force $F_2$.

Figure 3:
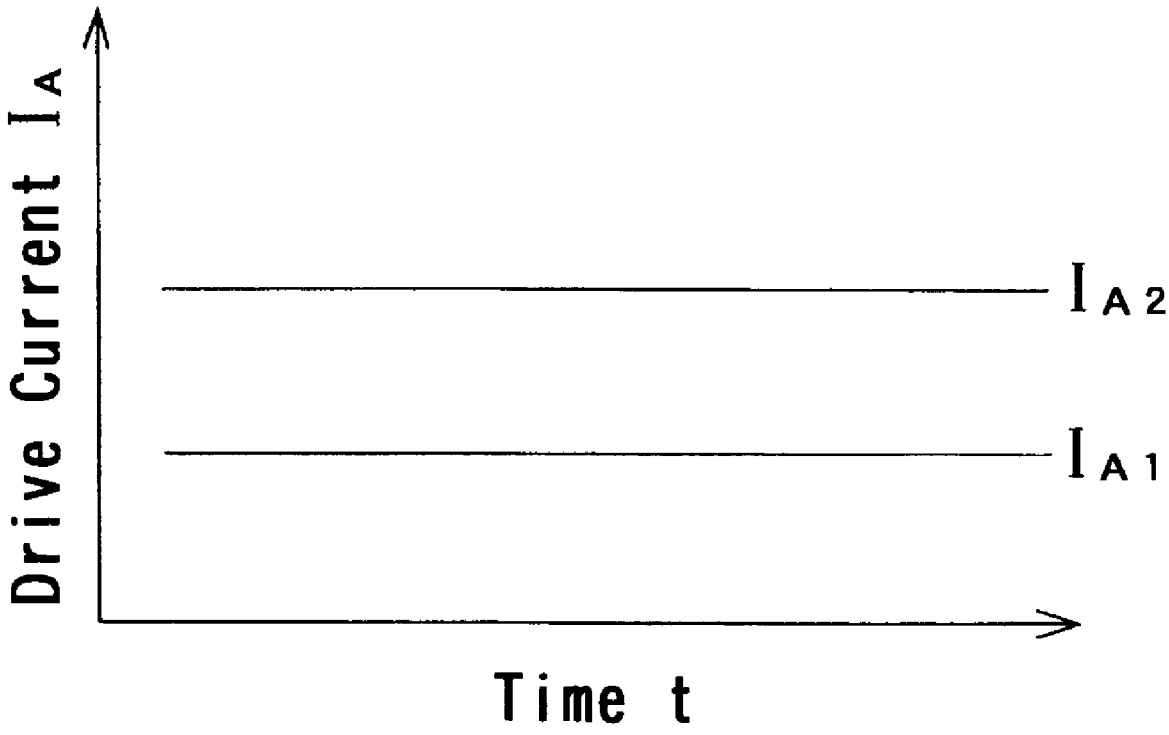
FIG. 3 is a graph showing an example of changes in drive current.

FIG. 3 is a graph showing an example of changes in drive current $I_A$ supplied to the polishing table motor 6. As shown in FIG. 3, when a frictional force between the polishing pad 2 and the dummy substrate 3' is equal to a frictional force $F_1$ produced between the protective layer 2*b* and the dummy substrate 3', i.e., before the initialization of the polishing pad 2 is completed, a drive current $I_{A1}$ is supplied to the polishing table motor 6. When a frictional force between the polishing pad 2 and the dummy substrate 3' becomes equal to a frictional force $F_2$ produced between the base layer 2*a* and the dummy substrate 3', i.e., when the initialization of the polishing pad 2 has been completed, a drive current $I_{A2}$ is supplied to the polishing table motor 6 ($I_{A1}<I_{A2}$). A drive current $I_B$ supplied to the top ring motor 7 is changed in a similar manner to the drive current $I_A$ supplied to the polishing table motor 6.

As shown in FIG. 1, the polishing apparatus includes a first current sensor 8 for detecting a drive current $I_A$ supplied to the polishing table motor 6, a second current sensor 9 for detecting a drive current $I_B$ supplied to the top ring motor 7, and a polishing pad condition detector 10 for detecting conditions of the polishing pad 2 based on the drive current $I_A$ detected by the first current sensor 8 and the drive current $I_B$ detected by the second current sensor 9. The frictional force $F_1$ produced between the protective layer 2*b* of the polishing pad 2 and the dummy substrate 3' and the frictional force $F_2$ produced between the base layer 2*a* of the polishing pad 2 and the dummy substrate 3' are different according to the types of polishing pads 2. Accordingly, for each type of polishing pad 2 attached to the upper surface of the polishing table 1, a driving current $I_{A1}$ and a driving current $I_{B1}$, which correspond to a frictional force $F_1$ produced between a protective layer 2*b* of a polishing pad 2 and a dummy substrate 3', and a driving current $I_{A2}$ and a driving current $I_{B2}$, which correspond to a frictional force $F_2$ produced between a base layer 2*a* of the polishing pad 2 and the dummy substrate 3', are previously inputted as thresholds into a memory and stored in the memory.

When a driving current $I_A$ detected by the first current sensor 8 or a driving current $I_B$ detected by the second current sensor 9 reaches the value $I_{A2}$ or $I_{B2}$ (threshold) stored in the memory, the polishing pad condition detector 10 determines that the initialization of the polishing pad 2 has been completed. When the polishing pad condition detector 10 thus determines that the initialization of the polishing pad 2 has been completed, the polishing pad condition detector 10 transmits a signal S representing the completion of the initialization process to a control device 11, which controls the polishing apparatus. In response to the signal S, the control device 11 controls the polishing table motor 6 or the top ring motor 7 so as to complete the initialization process of the polishing pad 2.

If initialization of the polishing pad 2 has not actually been completed even though the polishing pad condition detector 10 determines that initialization of the polishing pad 2 has been completed as described above, an additional dummy substrate is polished. A driving current $I_{A2}$ and a driving current $I_{B2}$ at the completion of the additional polishing process are inputted into the memory so as to update the thresholds in the memory. Thus, the initialization of the polishing pad 2 can be performed more accurately. In FIG. 1, the polishing pad condition detector 10 is provided separately from the control device 11 for controlling the polishing apparatus. However, a driving current $I_A$ detected by the first current sensor 8 and a driving current $I_B$ detected by the second current sensor 9 may be inputted into the control device 11, and the control device 11 may determine that the initialization of the polishing pad 2 has been completed. Specifically, the control device 11 may have the function of the polishing pad condition detector 10.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Polyurethane foam is porous and has a large number of fine recesses or holes formed in its surface.

Figure 4:
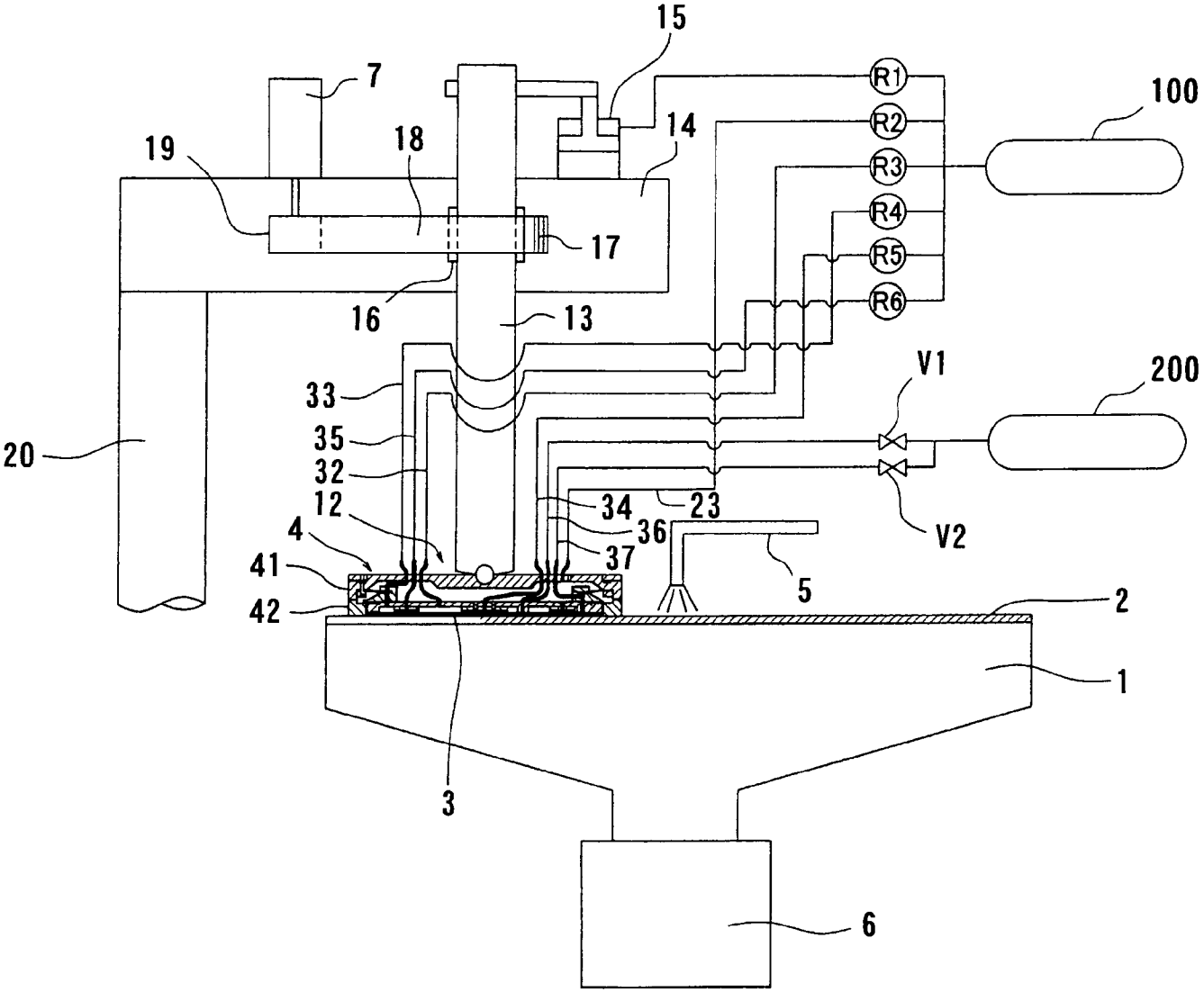
FIG. 4 is a schematic view showing an arrangement of the polishing apparatus shown in FIG. 1.

FIG. 4 is a schematic view showing an arrangement of the polishing apparatus in the present embodiment. The top ring 4 is connected to a top ring drive shaft 13 by a universal joint 12, and the top ring drive shaft 13 is coupled to a top ring air cylinder 15 fixed to a top ring head 14. The top ring air cylinder 15 is actuated to move the top ring drive shaft 13 in a vertical direction to thereby lift and lower the top ring 4 as a whole and to press a retainer ring 42 fixed to a lower end of a top ring body 41 against the polishing pad 2. The top ring air cylinder 15 is connected to a compressed air source (fluid supply source) 100 via a regulator R1, which can regulate pressure of compressed air or the like which is supplied to the top ring air cylinder 15. Thus, it is possible to adjust a pressing force to press the polishing pad 2 with the retainer ring 42.

The top ring drive shaft 13 is connected to a rotary sleeve 16 by a key (not shown). The rotary sleeve 16 has a timing pulley 17 fixedly disposed at a peripheral portion thereof. The top ring motor 7 is fixed to the top ring head 14, and the timing pulley 17 is coupled to a timing pulley 19 mounted on the top ring motor 7 via a timing belt 18. Accordingly, when the top ring motor 7 is energized for rotation, the rotary sleeve 16 and the top ring drive shaft 13 are rotated in unison with each other via the timing pulley 19, the timing belt 18, and the timing pulley 17 to thereby rotate the top ring 4. The top ring head 14 is supported on a top ring head shaft 20 fixedly supported on a frame (not shown). The top ring head shaft 20 is rotatable about its axis. When the top ring head shaft 20 is rotated, the top ring 4 is angularly moved.

Figure 5:
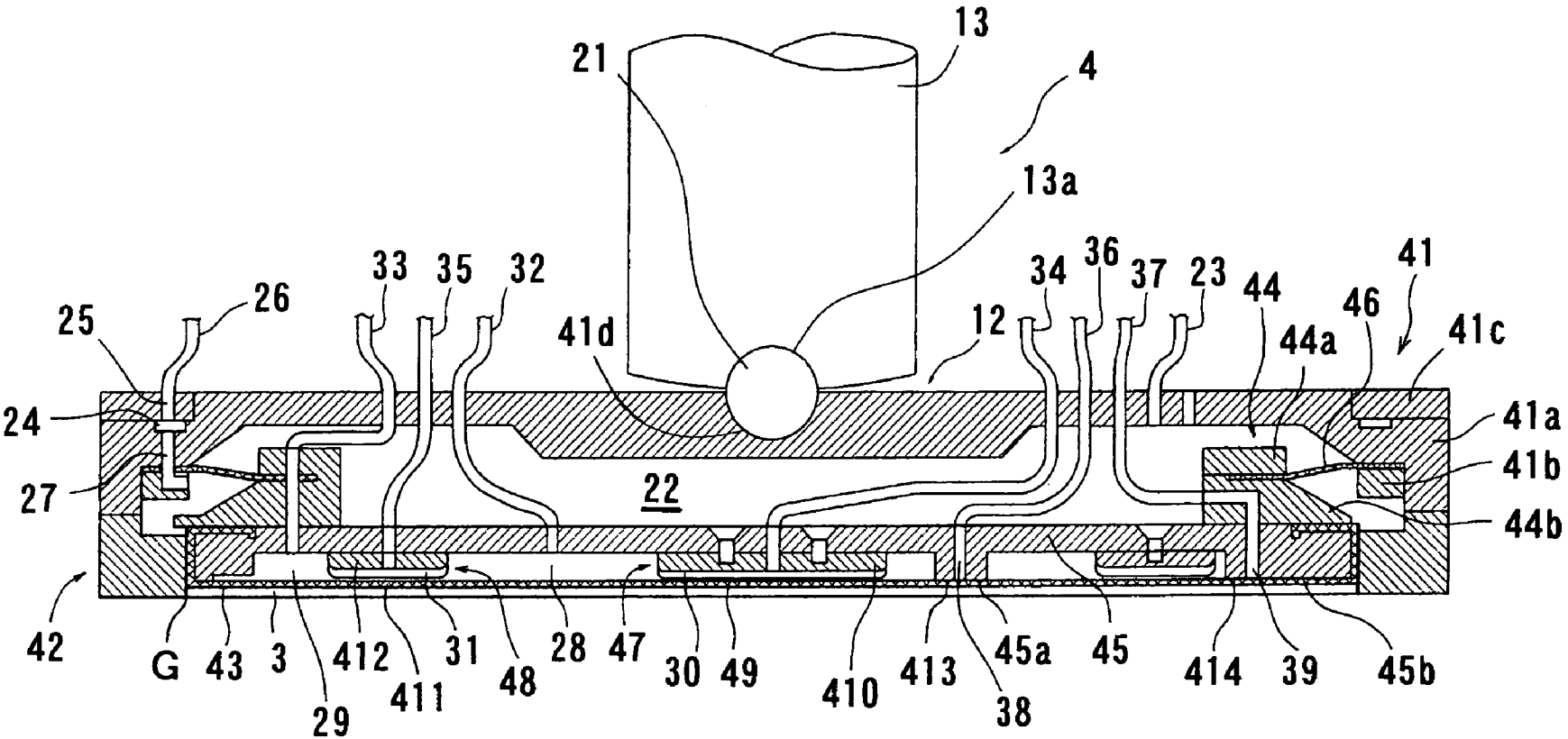
FIG. 5 is a vertical cross-sectional view showing a top ring in the polishing apparatus shown in FIG. 1.

FIG. 5 is a vertical cross-sectional view showing the top ring 4. As shown in FIG. 5, the top ring 4 has a top ring body 41 in the form of a cylindrical receptacle with a receiving space defined therein and a retainer ring 42 fixed to the lower end of the top ring body 41. The top ring body 41 is made of a material having high strength and rigidity, such as metal or ceramics. The retainer ring 42 is made of highly rigid synthetic resin, ceramics, or the like.

The top ring body 41 includes a cylindrical housing 41*a*, an annular pressurizing sheet support 41*b* fitted into a cylindrical portion of the housing 41*a*, and an annular seal 41*c* fitted over an outer circumferential edge of an upper surface of the housing 41*a*. The retainer ring 42 is fixed to the lower end of the housing 41*a* of the top ring body 41. The retainer ring 42 has a lower portion projecting radially inward. The retainer ring 42 may be formed integrally with the top ring body 41.

The top ring drive shaft 13 is disposed above a central portion of the housing 41*a* of the top ring body 41, and the top ring body 41 is coupled to the top ring drive shaft 13 by the universal joint 12. The universal joint 12 has a spherical bearing mechanism by which the top ring body 41 and the top ring drive shaft 13 are tiltable with respect to each other, and a rotation transmitting mechanism for transmitting rotation of the top ring drive shaft 13 to the top ring body 41. The spherical bearing mechanism and the rotation transmitting mechanism transmit a pressing force and a rotating force from the top ring drive shaft 13 to the top ring body 41 while allowing the top ring body 41 and the top ring drive shaft 13 to be tilted with respect to each other.

The spherical bearing mechanism includes a hemispherical concave recess 13*a* defined centrally in the lower surface of the top ring drive shaft 13, a hemispherical concave recess 41*d* defined centrally in the upper surface of the housing 41*a*, and a bearing ball 21 made of a highly hard material such as ceramics and interposed between the concave recesses 13*a* and 41*d*. Meanwhile, the rotation transmitting mechanism includes drive pins (not shown) fixed to the top ring drive shaft 13, and driven pins (not shown) fixed to the housing 41*a*. Even if the top ring body 41 is tilted with respect to the top ring drive shaft 13, the drive pins and the driven pins remain in engagement with each other while contact points are displaced because the drive pin and the driven pin are vertically movable relative to each other. Thus, the rotation transmitting mechanism reliably transmits rotational torque of the top ring drive shaft 13 to the top ring body 41.

The top ring body 41 and the retainer ring 42 secured to the top ring body 41 have a space defined therein, which accommodates therein an elastic pad (membrane) 43 having a lower surface (substrate holding surface) brought into contact with the substrate 3 held by the top ring 4, an annular holder ring 44, and a disk-shaped chucking plate 45 for supporting the elastic pad 43. The elastic pad 43 has a radially outer edge clamped between the holder ring 44 and the chucking plate 45 secured to the lower end of the holder ring 44 and extends radially inward so as to cover the lower surface of the chucking plate 45. Thus, a space is defined between the elastic pad 43 and the chucking plate 45.

The chucking plate 45 may be made of metal. However, when the thickness of a thin film formed on a surface of a substrate (e.g., a semiconductor wafer) is measured by a method using eddy current in a state such that the substrate 3 to be polished is held by the top ring 4, the chucking plate 45 should preferably be made of a non-magnetic material, e.g., an insulating material such as fluororesin or ceramics.

A pressurizing sheet 46 comprising an elastic membrane extends between the holder ring 44 and the top ring body 41. The pressurizing sheet 46 has a radially outer edge clamped between the housing 41*a* and the pressurizing sheet support 41*b* of the top ring body 41, and a radially inner edge clamped between an upper end portion 44*a* and a stopper 44*b* of the holder ring 44. The top ring body 41, the chucking plate 45, the holder ring 44, and the pressurizing sheet 46 jointly define a pressure chamber 22 in the top ring body 41. A fluid passage 23 comprising tubes and connectors communicates with the pressure chamber 22, which is connected to the compressed air source 100 via a regulator R2 provided on the fluid passage 23 as shown in FIG. 4. The pressurizing sheet 46 is made of a highly strong and durable rubber material such as ethylene propylene rubber (EPDM), polyurethane rubber, or silicone rubber.

A cleaning liquid passage 24 in the form of an annular groove is defined in the upper surface of the housing 41*a* near its outer circumferential edge over which the seal 41*c* of the top ring body 41 is fitted. The cleaning liquid passage 24 communicates with a fluid passage 26 through a throughhole 25 formed in the seal 41*c*, and is supplied with a cleaning liquid (e.g., pure water) through the fluid passage 26. A plurality of communication holes 27 are defined in the housing 41*a* and the pressurizing sheet support 41*b* in communication with the cleaning liquid passage 24. The communication holes 27 communicate with a small gap G defined between the outer circumferential surface of the elastic pad 43 and the inner circumferential surface of the retainer ring 42.

A central bag 47 and a ring tube 48, which serve as abutment members brought into contact with the elastic pad 43, are mounted in a space defined between the elastic pad 43 and the chucking plate 45. In the present embodiment, as shown in FIG. 5, the central bag 47 is disposed centrally on the lower surface of the chucking plate 45, and the ring tube 48 is disposed radially outward of the central bag 47 in surrounding relation thereto. Each of the elastic pad 43, the central bag 47, and the ring tube 48 is made of a highly strong and durable rubber material such as ethylene propylene rubber (EPDM), polyurethane rubber, or silicone rubber.

The space defined between the chucking plate 45 and the elastic pad 43 is divided into a plurality of spaces by the central bag 47 and the ring tube 48. Accordingly, a pressure chamber 28 is defined between the central bag 47 and the ring tube 48, and a pressure chamber 29 is defined radially outward of the ring tube 48.

The central bag 47 includes an elastic membrane 49 brought into contact with the upper surface of the elastic pad 43, and a central bag holder 410 for detachably holding the elastic membrane 49 in position. The central bag 47 has a central pressure chamber 30 defined therein by the elastic membrane 49 and the central bag holder 410. Similarly, the ring tube 48 includes an elastic membrane 411 brought into contact with the upper surface of the elastic pad 43, and a ring tube holder 412 for detachably holding the elastic membrane 411 in position. The ring tube 48 has an intermediate pressure chamber 31 defined therein by the elastic membrane 411 and the ring tube holder 412.

Fluid passages 32 to 35 comprising tubes and connectors communicate with the pressure chambers 28 to 31, respectively. As shown in FIG. 4, the pressure chambers 28, 29, 30, and 31 are connected to the compressed air source 100 via respective regulators R3, R4, R5 and R6 connected respectively to the fluid passages 32, 33, 34, and 35. The fluid passages 23, 32, 33, 34, and 35 are connected to the respective regulators R2, R3, R4, R5, and R6 through a rotary joint (not shown) mounted on the upper end of the top ring shaft 13.

The pressure chamber 22 above the chucking plate 45 and the pressure chambers 28, 29, 30, and 31 are supplied with pressurized fluids such as pressurized air or atmospheric air or evacuated, via the fluid passages 23, 32, 33, 34, and 35 connected to the respective pressure chambers. As shown in FIG. 4, the regulators R2, R3, R4, R5, and R6 connected to the fluid passages 23, 32, 33, 34 and 35 of the pressure chambers 22, 28, 29, 30, and 31 can respectively regulate the pressures of the pressurized fluids supplied to the respective pressure chambers. Thus, it is possible to independently control the pressures in the pressure chambers 22, 28, 29, 30, and 31, or independently introduce atmospheric air or vacuum into the pressure chambers 22, 28, 29, 30, and 31. In this manner, the pressures in the pressure chambers 22, 28, 29, 30, and 31 are independently varied with the regulators R2, R3, R4, R5, and R6, so that the pressing forces to press the substrate (e.g., semiconductor wafer) 3 via the elastic pad 43 against the polishing pad 2 can be adjusted in local areas of the substrate 3.

The elastic pad 43 has a plurality of openings. Inner suction portions 45*a* project downward from the chucking plate 45 so as to be exposed through the openings which are positioned between the central bag 47 and the ring tube 48. Outer suction portions 45*b* project downward from the chucking plate 45 so as to be exposed through the openings which are positioned radially outward of the ring tube 48. The inner suction portions 45*a* and the outer suction portions 45*b* have communication holes 38 and 39 communicating with fluid passages 36 and 37, respectively. As shown in FIG. 4, the suction portions 45*a* and 45*b* are connected to the vacuum source 200 such as a vacuum pump via the fluid passages 36 and 37 and valves V1 and V2. When the communication holes 38 and 39 of the suction portions 45*a* and 45*b* are connected to the vacuum source 121, a negative pressure is developed at the lower opening ends of the communication holes 38 and 39 thereof to attract the substrate 3 to the lower ends of the suction portions 45*a* and 45*b*. The suction portions 45*a* and 45*b* have elastic sheets 413 and 414, such as thin rubber sheets, attached to their lower ends, for thereby elastically contacting and holding the substrate 3 on the lower surfaces thereof.

When a substrate 3 or a dummy substrate 3' is to be held by the top ring 4, the valves V1 and V2 are opened to connect the fluid passages 36 and 37 to the vacuum source 200. Thus, the substrate 3 or the dummy substrate 3' is attracted to the suction portions 45*a* and 45*b* under vacuum and held on the lower surface of the elastic pad 43. Then, the substrate 3 or the dummy substrate 3' is brought into contact with the polishing pad 2 on the polishing table 1 and pressed against the polishing pad 2. The pressing force to press the substrate 3 or the dummy substrate 3' against the polishing pad 2 is adjusted by regulating a compressed air to be supplied via the regulator RI to the top ring air cylinder 15.

While the present invention has been described in detail with reference to the preferred embodiment thereof, it would be apparent to those skilled in the art that many modifications and variations may be made therein without departing from the spirit and scope of the present invention. The present invention is not limited to the above embodiment, in which the substrate 3 or the dummy substrate 3' held by the rotating top ring 4 is pressed against the polishing pad 2 on the rotating polishing table 1 to polish the substrate 3 or initialize the polishing pad 2. The present invention is applicable to any polishing apparatus as long as a substrate or a dummy substrate is pressed against a polishing pad to polish the substrate or initialize the polishing pad by relative movement between the polishing pad and the substrate or the dummy substrate.

In the present embodiment, a dummy substrate is polished when a new polishing pad is initialized. When a dresser such as a diamond dresser or a brush dresser is used to initialize a polishing pad, an endpoint of the initialization of the polishing pad can also be detected by a drive current for driving the dresser. In the present embodiment, the polishing pad 2 is attached onto the rotatable polishing table 1. However, the present invention is applicable to a polishing apparatus having a polishing pad in the form of a linearly movable belt. Further, in the present embodiment, a drive current for driving the top ring or the polishing table is measured to detect an endpoint of removing the protective layer of the polishing pad. However, an endpoint of removing the protective layer of the polishing pad can also be detected by emitting light to the polishing pad and measuring a change of reflected light from the polishing pad.

Although certain preferred embodiments of the present invention have been shown and described in detail, it should be understood that various changes and modifications may be made therein without departing from the scope of the appended claims.

What is claimed is:

1. A method comprising:

attaching a polishing pad having a base layer and a protective layer formed on the base layer to a polishing table;

bringing a surface of a dummy workpiece into contact with the polishing pad and pressing the dummy workpiece against the polishing pad by a workpiece holder to remove the protective layer of the polishing pad;

driving at least one of the polishing table and the workpiece holder so as to provide a relative movement between the polishing pad and the dummy workpiece;

detecting a drive current supplied for driving at least one of the polishing table and the workpiece holder; and detecting removal of the protective layer of the polishing pad based on the detected drive current.

2. The method as recited in claim 1, wherein said detecting removal of the protective layer of the polishing pad comprises:

comparing the detected drive current with a predetermined threshold; and detecting completion of an initialization process of the polishing pad when the detected drive current reaches the predetermined threshold.

3. A method comprising:

attaching a polishing pad having a base layer and a protective layer formed on the base layer to a polishing table;

bringing a surface of a dummy workpiece into contact with the polishing pad and pressing the dummy workpiece against the polishing pad by a workpiece holder to remove the protective layer of the polishing pad;

driving at least one of the polishing table and the workpiece holder so as to provide a relative movement between the polishing pad and the dummy workpiece;

detecting a drive current supplied for driving at least one of the polishing table and the workpiece holder;

detecting removal of the protective layer of the polishing pad based on the detected drive current; and bringing a surface of a workpiece into contact with the polishing pad and pressing the workpiece against the polishing pad by the workpiece holder to polish the workpiece after said detecting removal of the protective layer of the polishing pad.

4. The method as recited in claim 3, wherein said detecting removal of the protective layer of the polishing pad comprises:

comparing the detected drive current with a predetermined threshold; and detecting completion of an initialization process of the polishing pad when the detected drive current reaches the predetermined threshold.

5. A method comprising:

attaching a polishing pad having a base layer and a protective layer formed on the base layer to a polishing table;

bringing a dresser into contact with the polishing pad and pressing the dresser against the polishing pad to remove the protective layer of the polishing pad;

driving at least one of the polishing table and the dresser so as to provide a relative movement between the polishing pad and the dresser;

detecting a drive current supplied for driving at least one of the polishing table and the dresser; and detecting removal of the protective layer of the polishing pad based on the detected drive current.

6. The method as recited in claim 5, wherein said detecting removal of the protective layer of the polishing pad comprises:

comparing the detected drive current with a predetermined threshold; and detecting completion of an initialization process of the polishing pad when the detected drive current reaches the predetermined threshold.

7. A method for removing a protective layer on a base layer of a polishing pad, said method comprising:

attaching the polishing pad to a polishing table;

bringing a surface of a dummy workpiece into contact with the polishing pad and pressing the dummy workpiece against the polishing pad by a workpiece holder to remove the protective layer of the polishing pad;

driving at least one of the polishing table and the workpiece holder so as to provide a relative movement between the polishing pad and the dummy workpiece;

detecting a drive current supplied for driving at least one of the polishing table and the workpiece holder; and detecting removal of the protective layer of the polishing pad based on the detected drive current.

* * * * *